US006580743B1

(12) United States Patent
Hirata et al.

(10) Patent No.: US 6,580,743 B1
(45) Date of Patent: Jun. 17, 2003

(54) STAVE COOLER

(75) Inventors: Mitsuji Hirata, Kitakyushu (JP); Kazushi Kishigami, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/914,105

(22) PCT Filed: Oct. 22, 2001

(86) PCT No.: PCT/JP00/01126

§ 371 (c)(1),
(2), (4) Date: Aug. 22, 2001

(87) PCT Pub. No.: WO00/50831

PCT Pub. Date: Aug. 31, 2000

(30) Foreign Application Priority Data

Feb. 26, 1999 (JP) ..... 11-049919

(51) Int. Cl.[7] ..... F27D 1/00; F27D 1/12
(52) U.S. Cl. ..... 373/75; 373/74; 373/76
(58) Field of Search ..... 373/71, 72, 75, 373/76, 42, 44, 155, 156; 432/238, 248; 266/193, 194, 190; 122/68, 6 A, 6 B; 164/100, 102, 107; 110/336

(56) References Cited

U.S. PATENT DOCUMENTS 4,221,922 A * 9/1980 Okimune ..... 373/76
4,327,900 A * 5/1982 Engel et al. ..... 122/6 A
4,382,585 A * 5/1983 Fischer et al. ..... 266/190
4,453,253 A * 6/1984 Lauria et al. ..... 373/74
4,637,034 A * 1/1987 Grageda ..... 373/76
6,137,823 A * 10/2000 Johnson et al. ..... 373/76
6,258,315 B1 * 7/2001 Araki et al. ..... 266/193

FOREIGN PATENT DOCUMENTS

| | | |
|---|---|---|
| JP | 5-320727 | 12/1993 |
| JP | 6-47347 | 6/1994 |
| JP | 7-118715 | 5/1995 |
| JP | 7-242917 | 9/1995 |
| JP | 8-104910 | 4/1996 |
| JP | 8-120313 | 5/1996 |

* cited by examiner

*Primary Examiner*—Tu Ba Hoang
(74) *Attorney, Agent, or Firm*—Kenyon & Kenyon

(57) ABSTRACT

A stave cooler used for cooling a furnace wall of a metallurgical furnace such as a blast furnace, having a structure in which cooling pipes to cool a metal base are cast on the side opposite the furnace interior side of the metal base and a heat resistant steel plate having openings or a lamination of heat resistant steel plates having openings is cast, in a prescribed thickness, in the furnace interior side surface of the metal base. It is acceptable to form the lamination suitably into a rectangular parallelepiped and cast it, in a plurality, in the furnace interior side of the metal base. The wear rate of the furnace interior side surface of the stave cooler is small, and its structure prevents the heat resistant steel plate(s) from falling out by thermal expansion of the stave cooler proper or wearing locally.

11 Claims, 6 Drawing Sheets

STAVE COOLER

TECHNICAL FIELD

This invention relates to a stave cooler used for, cooling a furnace body by being attached to a furnace wall of a metallurgical furnace such as a blast furnace, an electric arc furnace and the like.

BACKGROUND ART

A stave cooler used as a cooling unit of a furnace wall of a metallurgical furnace such as a blast furnace and the like, becomes worn or broken through protracted use. When a stave cooler sustains such wear or breakage, its cooling ability lowers and heat loads on furnace shells increase, the increased heat loads leading to the occurrence of cracks in the furnace shells.

Generally speaking, a stave cooler is constructed in a manner in which,as shown in FIG. 7, cooling pipes 2 are embedded by casting in base metal (usually nodular graphite cast iron) forming the stave cooler proper 1 on the side opposite the furnace interior side and refractory bricks 9 are cast integrally on the furnace interior side as refractory materials. The stave cooler is fixed to the interior surface of a furnace shell 7 and refractory bricks 8 are piled on the furnace interior side of the stave cooler with stamp material 12 in-between.

A stave cooler of different structure has been proposed, wherein, instead of piling the refractory bricks, refractory bricks 10 are cast in the stave cooler proper 1 on the furnace interior side in a manner where the bricks 10 are supported, row by row, between ribs 11 of the base metal as shown in FIGS. 8(*a*) and 8(*b*).

The refractory bricks cast in the furnace interior side of the stave cooler have to be excellent in resistance against wear caused by the flow of high temperature gas and dropping of the material inside the furnace and in heat insulation ability to prevent a decrease in thermal efficiency caused by heat transfer from the furnace interior. The stave cooler thus functions, thanks to cooling water flowing through the cooling pipes, to cool, besides the furnace wall, the base metal and/or the refractory bricks on the furnace interior side so as to maintain their strength in reducing the rate of wear of the base metal and/or the refractory bricks caused by dropping of the material in the furnace, even when wear is accelerated by an increase in the heat load in the furnace interior.

However, the structure of the stave cooler shown in FIG. 7, where refractory bricks are piled on the furnace interior side, is unstable because there are no structural members to support the refractory bricks and they are supported only by the bonding strength of the binder between them. For this reason, the stave cooler of this structure has a problem in that the refractory bricks can fall out, locally or over the entire surface, in a hot and abrasive environment such as that in a blast furnace, and the service life as a refractory structure is drastically reduced as a result.

In addition, using the structure of the stave cooler shown in FIGS. 8(*a*) and 8(*b*), in which structure the refractory bricks are embedded in the base metal by casting, the force supporting the refractory bricks is weak, since they are supported only by the base metal ribs with a cushioning material (ceramic felt, etc.) placed in-between for preventing the bricks from cracking during casting of the stave. For this reason, a stave cooler of this structure is prone to a problem in which the refractory bricks fall out or break as a result of the change in the gaps between the ribs caused by thermal expansion/shrinkage during furnace operation.

If the refractory bricks thus fall out or break in an early stage of use leaving the base metal ribs behind, the furnace interior surface becomes irregular and, as a result, the dropping of the material in the furnace becomes discontinuous and unstable.

In addition, in order to minimize heat flux from the furnace interior, refractory bricks having a good heat insulation ability are chosen. If the refractory bricks fall out in an early stage of use, even locally, the stave cooler cannot maintain its heat insulation ability for a long period and, adversely, the heat loss tends to be increased by the influence of the ribs left protruding towards the furnace interior after the bricks have fallen out.

To solving this problem, Japanese Unexamined Patent Publication No. H8-120313 discloses a structure of a stave cooler in which columnar bricks having a round or polygonal section shape are arranged on the furnace interior side of the stave cooler perpendicularly to the surface and not contacting each other so that each of the bricks is wrapped around on all sides by the base metal, and Japanese Unexamined Patent Publication No. H5-320727 discloses another structure of a stave cooler in which refractory bricks, each positioned by a support anchor fitted into a tapered hole drilled through the brick near its center, are arranged in a zigzag pattern and embedded integrally in a base metal by casting.

However, when refractory bricks are arranged separately with a certain gap between them, each of them must be held to prevent from floating at casting and their positioning is difficult, and therefore, the manufacturing of the stave cooler requires a substantially long time.

The refractory bricks have also to be wrapped with a cushioning material such as ceramic felt or the like to prevent cracking resulting from heat shock during casting, but the work efficiency of the brick wrapping work piece by piece with the cushioning material is very. low.

In the structures described above, the chance of the refractory bricks falling out is small, since they are wrapped around by the base metal, but there still remains a possibility that they will crack or flake off as a result of thermal deformation of the stave cooler proper.

In addition to the above, Japanese Unexamined Utility Model Publication No. H6-47347 discloses two stave cooler structures: one using stainless steel blocks as a refractory material, dovetail grooves cut on the furnace interior side of the stave cooler proper, mortar applied inside the grooves to adjust gaps, and fitting and fixing of the stainless steel blocks having a tapered section shape into the grooves; and the other involving forming pits having a quadrilateral section shape on the furnace interior side of a stave cooler, fitting stainless steel blocks having a quadrilateral section shape into the pits and weld the furnace interior side surface of each block to the stave cooler proper.

In either case, however, the stainless steel blocks are fitted and fixed into the grooves or the pits of the stave cooler proper after its casting, and stainless steel blocks are heavier than bricks. For these reasons, the manufacturing work efficiency is very low.

Further, since stainless steel blocks having a tapered section are fitted in the dovetail grooves with mortar in-between for adjusting gaps, the strength of support for the blocks is weak and thus it is possible blocks will fall out owing to thermal deformation of the stave cooler proper.

Stainless steel blocks having a quadrilateral section, on the other hand, are supported only by the welding at the surface and thus it is possible the blocks will fall out like the tapered section stainless steel blocks, when the welded portions fracture due to the difference in the coefficient of thermal expansion of the stainless steel and the nodular graphite cast iron of the base metal or when they are worn by the dropping of the material.

In addition, manufacturing of the blocks is costly when they are made from rolled stainless steel materials.

DISCLOSURE OF THE INVENTION

The object of the present invention is to solve the above problems and provide, more economically, a stave cooler having a long service life and capable of maintaining heat insulation ability and wear resistance for a long period.

Thus, the gist of the present invention is as follows:

(1) A stave cooler to cool a furnace body, having a structure in which cooling pipes to cool a base metal are cast on the side opposite the furnace interior side of the base metal, characterized by casting a heat resistant steel plate having openings or a lamination of heat resistant steel plates having openings in the furnace interior side of the base metal.

(2) A stave cooler to cool a furnace body according to the item (1), characterized in that the heat resistant steel plate(s) having openings is/are a latticed or slotted heat resistant steel plate(s).

(3) A stave cooler to cool a furnace body according to the item (1) or (2), characterized in that the thickness of the heat resistant steel plate or that of the lamination of the steel plates is 3 mm or more and ⅔ or less of the thickness of the stave cooler.

(4) A stave cooler to cool a furnace body according to the item (1), (2) or (3), characterized in that, in the lamination of the heat resistant steel plates, the positions of the openings of a heat resistant steel plate are different from those of an adjacent heat resistant steel plate.

(5) A stave cooler to cool a furnace body according to the item (1), (2), (3) or (4), characterized in that the net volume of the heat resistant steel plate(s) is 20 to 60% of its/their gross volume, namely the sum of the net volume of the heat resistant steel plate(s) and the volume of the space of the openings.

(6) A stave cooler to cool a furnace body according to the item (1), (2), (3)1, (4) or (5), characterized in that the minimum width of the openings of the heat resistant steel plate(s) having openings is 30 mm or more and 70 mm or less.

(7) A stave cooler to cool a furnace body according to the item (1), (2), (3), (4), (5) or (6), characterized in that the heat resistant steel plate(s) is/are austenitic or ferritic heat resistant steel plate(s).

(8) A stave cooler to cool a furnace body, having a structure in which cooling pipes to cool a base metal are cast on the side opposite the furnace interior side of the base metal, characterized by forming a latticed or slotted heat resistant steel plate having openings or a lamination of latticed or slotted heat resistant steel plates having openings into a rectangular parallelepiped, and casting it, in a plurality, in the furnace interior side of the base metal.

(9) A stave cooler to cool a furnace body according to the item (8), characterized in that the thickness of the rectangular parallelepiped is 3 mm or more and ⅔ or less of the thickness of the stave cooler.

(10) A stave cooler to cool a furnace body according to the item (8) or (9), characterized in that, in said rectangular parallelepiped, the positions of the openings of a heat resistant steel plate are different from those of an adjacent heat resistant steel plate.

(11) A stave cooler to cool a furnace body according to the item (8), (9) or (10), characterized in that the net volume of the rectangular parallelepiped is 20 to 60% of its gross volume, namely the sum of the net volume of the heat resistant steel plate(s) and the volume of the space of the openings.

(12) A stave cooler to cool a furnace body according to the item (8), (9), (10) or (11), characterized in that in the rectangular parallelepiped the minimum width of the openings is 30 mm or more and 70 mm or less.

(13) A stave cooler to cool a furnace body according to the item (8), (9), (10), (11) or (12), characterized in that the heat resistant steel plate(s) is/are austenitic or ferritic heat resistant steel plate(s).

BRIEF DESCRIPTION OF THE DRAWINGS

FIG. 1(*b*) is a front elevation view of the stave cooler shown in FIG. 1(*a*).

FIG. 2(*b*) is a view showing how the slots of the heat resistant steel plates cross each other in the stave cooler shown in FIG. 2(*a*).

FIG. 2(*c*) is a front elevation view of the stave cooler shown in FIG. 2(*a*).

FIG. 3(*b*) is a view showing an example of the slotted heat resistant steel plate having openings, wherein the slots are formed longitudinally.

FIG. 3(*c*) is a view showing another example of the slotted heat resistant steel plate having openings, wherein the slots are formed obliquely.

FIG. 3(*d*) is a view showing another example of the heat resistant steel plate having openings, wherein the openings are round-shaped.

FIG. 4(*b*) is a front elevation view of the stave cooler shown in FIG. 4(*a*).

FIG. 6(*b*) is a view explaining the positional interrelation of lattice meshes in the lamination shown in FIG. 6(*a*).

FIG. 8(*b*) is a sectional view of the conventional stave cooler shown in FIG. 8(*a*)

BEST MODE FOR CARRYING OUT THE INVENTION

Figure 1A:
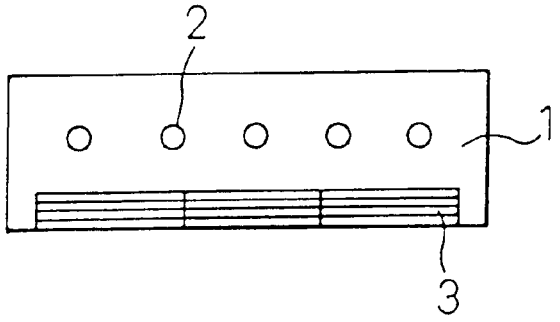
FIG. 1(*a*) is a sectional view of a stave cooler in which latticed heat resistant steel plates having openings are piled into a lamination and arranged in the furnace interior side surface of the stave cooler in a manner to form a flat surface.

The present invention employs a structure in which heat resistant steel late(s) having excellent resistance against wear and clacking in a hot and highly abrasive environment is/are cast in the furnace interior side surface of a stave cooler.

The heat resistant steel is required, besides the above, to be excellent in heat insulation ability, high temperature strength, high temperature corrosion resistance and high temperature stability (transformation resistance), etc.

Heat resistant steels of any chemical composition can be used for the purpose of the present invention insofar as the required properties above are satisfied but, in actual practice, the most suitable kind of heat resistant steel is selected in consideration of the temperature and other conditions of the environment to which the stave cooler is exposed and steel chemistry.

Austenitic heat resistant steel (such as 18Cr-8Ni steel, 22Cr-12Ni steel and 25Cr-20Ni steel, etc.) satisfies the required properties and is the most suitable for the present invention.

A plate or plates of heat resistant steel having openings in the form of a lattice, slot, or the like as shown in FIG. 3 is/are used. This is for the purpose of forming a composite by embedding the plate(s) integrally in the base metal by casting.

Further, the present invention adopts a structure in which a heat resistant steel plate having openings or heat resistant steel plates having openings piled into a lamination is/are cast in the base metal on the furnace interior side of a stave cooler.

In principle, that nodular graphite cast iron is used for the base metal.

It is not easy to embed the plate or plates of heat resistant steel in the base metal (nodular graphite cast iron) on the,furnace interior side surface of the stave cooler when the plate(s) cover(s) the whole surface, because incomplete fusion bonding between the base metal and the heat resistant steel plate(s) occurs during manufacturing. In the present invention, however, it is possible to embed in the base metal the heat resistant steel plate(s) arranged to cover the entire surface on the furnace interior side of the stave cooler, since the steel plate(s) has/have openings.

To ensure the homogeneity and function of the stave cooler, the area of the heat resistant steel plate(s) including the area of the openings is 60 to 100%, more preferably 80 to 100%, of the area of the stave cooler surface on the furnace interior side. When the area of the heat resistant steel plate(s) including the area of the openings is 60% or less of the area of the stave cooler surface on the furnace interior side, the purpose of the present invention cannot be achieved.

In the present invention, further, thanks to the use of the heat resistant steel plate(s) having openings, it is easier to maintain the volume ratio of the embedded material (the latticed heat resistant steel plate(s)) in the base metal homogeneous in the whole surface than in the case where a plain plate or plain plates of heat resistant steel is/are used.

When refractory bricks are to be embedded, measures are required in the casting process to prevent the refractory bricks from floating because of their specific gravity being less than that of molten base metal and from cracking caused by thermal shock and stress (provision of cushioning materials such as wrapping with ceramic felt). In the present invention, however, the measures to prevent floating and cracking are not required, since what is embedded is/are heat resistant steel plate(s) having openings. Thus, the problem of the low work efficiency of the above measures, mentioned earlier, is solved.

In the present invention, it is preferable that the thickness of the heat resistant steel plate or that of the lamination of the steel plates be 3 mm or more and ⅔ or less of the thickness of the stave cooler.

Any thickness value of the heat resistant steel plate(s) can be selected within the above range in view of the target service life of the stave cooler.

When the thickness of the heat resistant steel plate(s) is below 3 mm, the steel plate(s.) is/are partially melted during the embedding work and an appropriate shape cannot be maintained, and thus the lower limit of the thickness is set at 3 mm.

The upper limit, on the other hand, is defined as ⅔ of the thickness of the stave cooler so as to ensure sufficient space for embedding the cooling pipes in the stave cooler and a sufficient molten metal pressure required for embedding the heat resistant steel plate or the heat resistant steel plates piled into a lamination.

When two or more heat resistant steel plates having openings are embedded in a lamination, however, it is preferable that there be a space of about 20 mm or less between each two of them.

This space is necessary to ensure penetration of the molten base mental during casting to every corner of the heat resistant steel plates to obtain strong fusion bonding between the base metal and the heat resistant steel plates.

When piling two or more heat resistant steel plates having openings, the positions of the openings of a steel plate are staggered from those of an adjacent heat resistant steel plate, as described later. When the heat resistant steel plates are piled in a manner to be in contact only at certain points, however, it is not necessary to keep space between them. But if there are portions where two heat resistant steel plates contact over the surfaces thereof even when the positions of the openings are staggered, there has to be a space of 20 mm at the maximum in order to ensure the molten metal penetration.

It should be noted that a space exceeding 20 mm is not desirable, since the homogeneity of the stave cooler after casting is impaired.

When piling two or more heat resistant steel plates having openings in the present invention, it is desirable that the openings of the steel plates be phased differently plate by plate so that the positions of the openings of a steel plate are different from those of an adjacent heat resistant steel plate.

For example, when piling latticed heat resistant steel plates, the lattice nodes of a steel plate must not overlap those of an adjacent plate and, when piling slotted heat resistant steel plates, the direction of the slots of a steel plate must be different from that of an adjacent plate.

This is for the purpose of ensuring good penetration of molten metal to every corner of the heat resistant steel plates during casting and forming a strongly integrated composite by firmly bonding the base metal and the heat resistant steel plates.

When two or more lattice nodes or slots overlap at the same position, a vertical wall is formed to restrict the flow of molten metal. For this reason, the lattice nodes or slots have to be positioned staggered from each other to ensure good flow of the molten metal.

Since the molten metal can flow without restriction when the heat resistant steel plates are piled as described above, its temperature drop is limited and it can fill every corner of the space around the heat resistant steel plates quickly while it is hot.

By the staggering the positioning of the lattice nodes or slots from each other, it is also possible to minimize uneven allocation of the heat resistant steel in the base metal and construct a stave cooler of a more homogeneous composite material.

In the present invention, it is possible also to control the boundary area between the heat resistant steel and the base metal (nodular graphite cast iron) per unit volume by suitably selecting the pattern of the openings and, consequently, it is possible to easily control the supporting strength of the base metal to hold the heat resistant steel plate(s) to a desired value.

It is desirable in the present invention, for integrally embedding the heat resistant steel plate(s) having openings in the base metal to form a composite, that the net volume of the heat resistant steel plate(s) be 20 to 60% of its/their gross volume, namely the sum of the net volume of the heat resistant steel plate(s) and the volume of the space of the openings.

When the net volume of the heat resistant steel plate(s) is below 20% of the gross volume, the advantage of the composite material is insufficient and, when it exceeds 60% of the gross volume, the supporting strength of the base metal to hold the steel plate(s) decreases and thus it is possible that the heat resistant steel plate(s) will fall out from the base metal, over a period of time, and that the service life of the stave cooler will be shortened.

For the purpose of firmly integrating the heat resistant steel plate(s) having openings in the base metal to form a composite, it is also desirable to form the openings of the heat resistant steel plate(s) so that their minimum width is 30 mm or more and 70 mm or less.

When the minimum width is below 30 mm, a satisfactory flow of molten base metal cannot be ensured and, when it exceeds 70 mm, on the other hand, desired material properties cannot be obtained in the furnace interior side portion of the stave cooler.

Either cast or rolled material can be used as the heat resistant steel plate(s), and the steel plate(s) can be manufactured by commonly practiced methods such as casting and machining, etc. An expanded metal sheet available on the market can be used as the latticed heat resistant steel plate. The expanded metal sheet is economical, since it is available on the market in a wide variety of opening dimensions, and can be easily used as the heat resistant steel plate of the present invention by selecting a suitable type and cutting to a desired dimension and piling into laminations.

Manufacturing the heat resistant steel plates having the openings by casting offers wide freedom in terms of material quality and shape, making it possible to provide desired material properties and design a shape suitable for the purpose of the product.

The present invention is, further, a stave cooler to cool a furnace body, characterized by casting rectangular parallelepipeds in the furnace interior side of the base metal, each of which rectangular parallelepipeds is formed of a heat resistant steel plate having openings or heat resistant steel plates having openings piled into a lamination.

A blast furnace, for example, is a shaft-shaped furnace and, hence a stave cooler installed in it is usually manufactured in a shape to fit an arc of the inner diameter of the portion of the furnace where it is installed. Because the shaft and bosh of a blast furnace are conical, with regard to a stave cooler installed especially in any of these portions, it is necessary to use different curvatures at different portions along the height of a stave cooler. For this reason, when manufacturing a conventional stave cooler structured to embed refractory bricks by casting, it is necessary to design materials of the refractory bricks and their embedment structure differently in accordance with different curvatures of different furnace portions.

In the present invention, however, it is possible to cope with different curvatures of different portions of a blast furnace versatilely by casting rectangular parallelepipeds in the base metal of a stave cooler on its furnace interior side, each of which rectangular parallelepipeds is formed of heat resistant steel plate having openings or heat resistant steel plates having openings piled into a lamination, in a manner to align the long sides of the rectangular parallelepipeds along the height of the stave cooler, for example.

It is possible to form the furnace interior side surface of a stave cooler, for example, by making the length of the short sides of the rectangular parallelepipeds equal to the length of a chord corresponding, for example, to an angle of about 1° of the inner diameter of the blast furnace and arranging the rectangular parallelepipeds on the furnace interior side surface of the stave cooler in the furnace circumference direction. It should be noted that the positions of the rectangular parallelepipeds are controlled by changing the width of the joints formed between the rectangular parallelepipeds in the direction of the stave cooler height.

Further, when the rectangular parallelepipeds are cast in the base metal in a manner to align their long sides in the direction of the height of the stave cooler as described above, the joints of the base metal are formed between the long sides of the rectangular parallelepipeds along the height direction of the stave cooler. This suppresses the deformation of the stave cooler caused by the heat load during blast furnace operation.

For this reason, the stave cooler according to the present invention is highly resistant against thermal deformation, especially against bending in the height direction, whereas a conventionally structured stave cooler having ribs for supporting refractory bricks running continuously in the width direction (see FIG. 8) does not have sufficient strength against thermal deformation, especially against bending in the height direction.

Figure 8A:
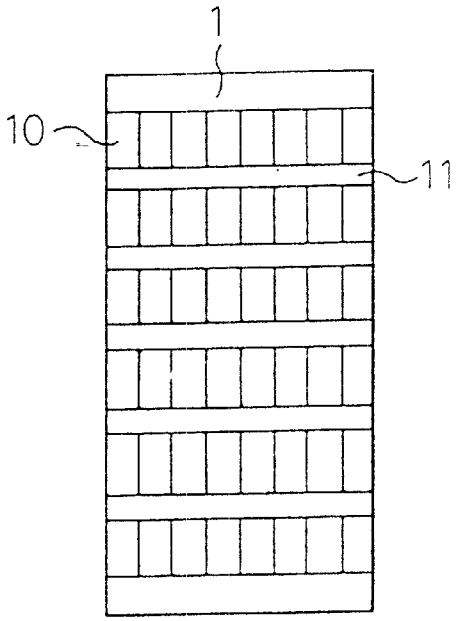
Fig.8(a) PRIOR ART
FIG. 8(*a*) is a front elevation view of another conventional stave cooler.
Figure 8B:
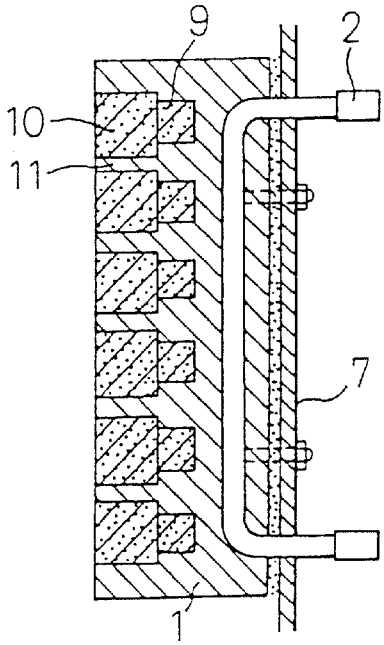
Fig.8(b) PRIOR ART

In this relation, the principal forms of damage inflicted on the refractory bricks of a conventionally structured stave cooler are abrasion caused by dropping of the material in the furnace and flaking caused by cracking resulting from fluctuation of heat load. According to an investigation of the present inventors regarding damage of the stave coolers having refractory bricks embedded as shown in FIG. 8 installed at a high heat load portion (lower shaft portion) of a blast furnace, the rate of wear was 40 to 50 mm/year in the embedded portions of the refractory bricks, 30 to 40 mm/year in the cast-in portions of the same, and 10 mm/year or less in the base metal of nodular graphite cast iron.

It is considered that the wear described above is mainly due to sliding abrasion caused by the dropping of the material in the furnace. It is also generally considered that the higher the steel hardness, the more resistant against wear and sliding abrasion the steel is. Hence, the heat resistant steel used in the present invention can be selected using hardness as a criterion.

Since the hardness of austenitic heat resistant steel is about 2 to 3 times that of nodular graphite cast iron, a stave cooler in which the heat resistant steel forms an integral composite with a base metal of nodular graphite cast iron has superior wear resistance to one composed only of base metal.

The wear rates of the bricks cited above are regarded as including falling out of bricks caused by thermal deformation of the stave cooler proper and their flaking caused by cracking resulting from the thermal deformation, in addition to the sliding abrasion. In the case that a plate or plates of austenitic heat resistant steel having openings is/are embedded in the base metal (nodular graphite cast iron) by casting, the falling out or flaking of bricks, expected to occur in the conventional structure having the embedded refractory bricks does not take place, because the heat resistant steel plate(s) is/are firmly integrated in the base metal (nodular graphite cast iron) forming a composite.

When austenitic heat resistant steel having good high temperature strength and excellent toughness is used as the heat resistant steel to be cast on the furnace interior side of a stave cooler as described above, a stave cooler having a longer service life than that of a conventionally structured stave cooler having refractory bricks embedded by casting is obtained, because the heat resistant steel is excellent also in crack resistance.

Ferritic heat resistant steel (such as 13Cr-low C steel and 18Cr steel, etc.) is also applicable to the present invention, but since it is inferior to austenitic heat resistant steel in high temperature stability, the maximum temperature of use is limited. Ferritic heat resistant steel is therefore applicable to stave coolers for use in the throat of a blast furnace where the temperature inside the furnace is lower.

The thermal expansion coefficient of austenitic heat resistant steel is about 1.3 times that of the nodular graphite cast iron of the base metal. This large difference in thermal expansion coefficient is mitigated and a generally homogeneous composite material can be obtained by embedding a latticed plate or latticed plates of the heat resistant steel by casting.

The thermal conductivity of austenitic heat resistant steel is comparatively low among metal materials: about ½ of that of the nodular graphite cast iron, but it is about three times that of the embedded refractory bricks of conventional structure. When austenitic heat resistant steel is used as the heat resistant steel for the present invention, therefore, the same level of heat resistance obtainable with the embedded refractory bricks cannot be expected. However, considering the fact that the service life of a stave cooler proper, especially in the case of a stave cooler installed in a high heat load portion, is determined by the wear rate of the brick portions as described before the present invention attaches importance to improvement of the wear resistance of a stave cooler by integrating the heat resistant steel to the base metal to form a composite material.

EXAMPLE

The present invention is explained in more detail hereafter based on the drawings.

Figure 1B:
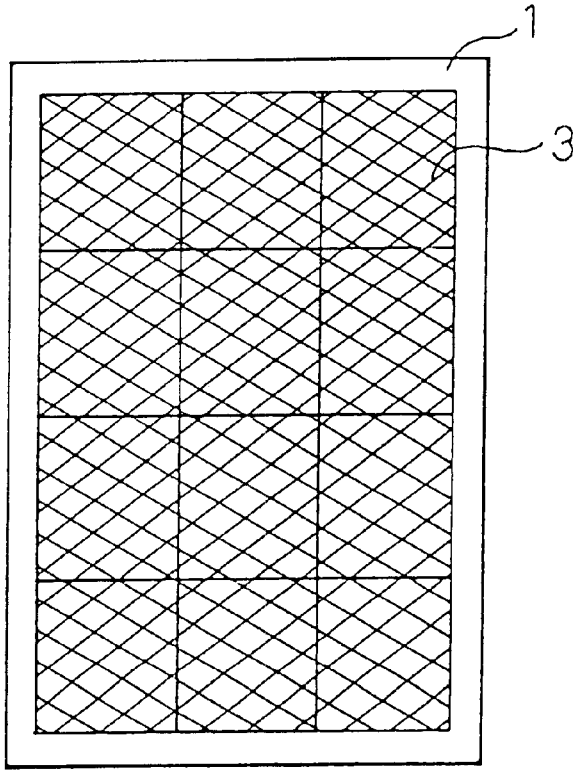

FIGS. 1(*a*) and (*b*) show a stave cooler in which latticed heat resistant steel plates 3 having openings (4 plates in the figures) are piled into a lamination or laminations and are arranged in a stave cooler proper 1 having a flat surface on its furnace interior side in a manner that the lattice surface(s) of the lamination(s) form(s) a part or parts of the flat surface.

Because the surface on the furnace interior side of the stave cooler is flat in this case, it is possible either to arrange the lamination of the heat resistant steel plates after dividing it into sections, in consideration of ease of work, or to arrange the lamination so that it covers the whole furnace interior side surface of the stave cooler.

Figure 2A:
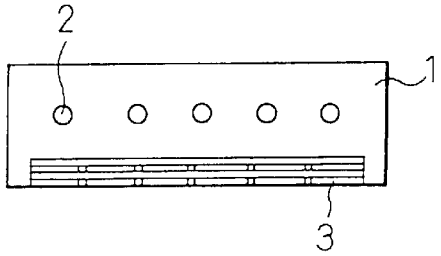
FIG. 2(*a*) is a sectional view of a stave cooler in which heat resistant steel plates having slots are piled into a lamination so that the slots of a heat resistant steel plate cross those of an adjacent heat resistant steel plate and arranged in the furnace interior side surface of the stave cooler in a manner to form a flat surface.
Figure 2B:
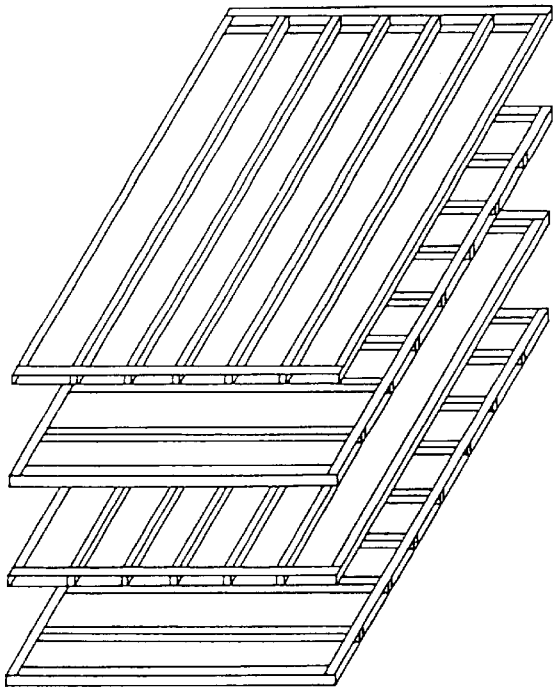
Figure 2C:
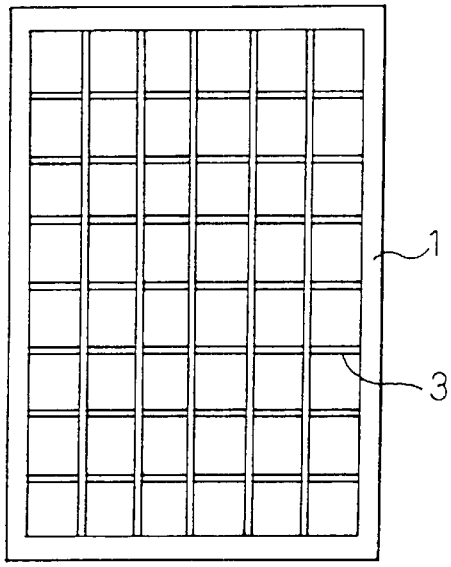
Figure 3A:
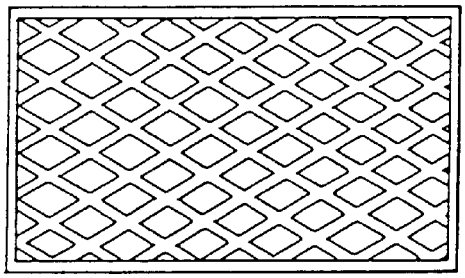
FIG. 3(*a*) is a view showing an example (such as an expanded metal sheet) of the heat resistant steel plate having openings.
Figure 3B:
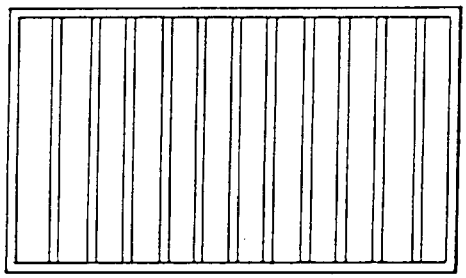
Figure 3C:
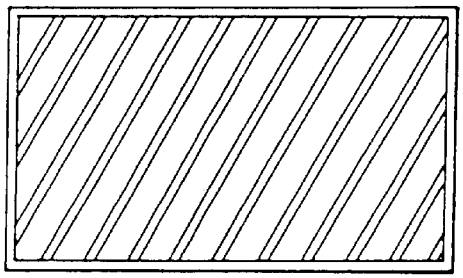
Figure 3D:
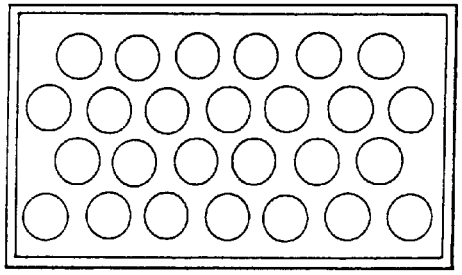

FIGS. 2(*a*), (*b*) and (*c*) show a stave cooler in which slotted heat resistant steel plates 3 having openings (4 plates in the figures) are piled into a laminations that the slots of adjacent steel plates cross each other.(see FIG. 2(*b*)) and arranged in a stave cooler proper 1 having a flat surface on its furnace interior side in a manner that the lattice surface of the lamination forms a part of the flat surface on the furnace interior side of the stave cooler.

FIGS. 3(*a*) to (*d*) show specific forms of the heat resistant steel plates having openings used in the present invention. FIG. 3(*a*) shows, for example, an expanded metal sheet, FIG. 3(*b*) a heat resistant steel plate having slots running longitudinally, FIG. 3(*c*) a heat resistant steel plate having slots running obliquely, and FIG. 3(*d*) a heat resistant steel plate having round-shaped openings.

Figure 4A:
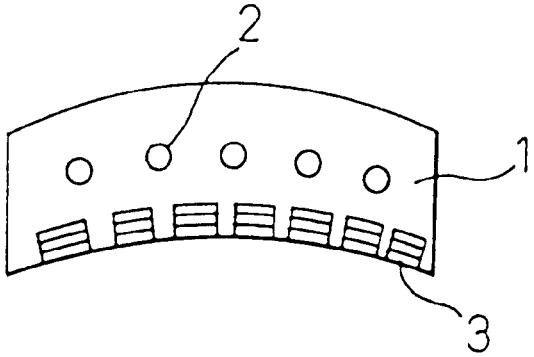
FIG. 4(*a*) is a sectional view of a stave cooler in which rectangular parallelepipeds composed of latticed heat resistant steel plates having openings piled into a lamination are arranged in the furnace interior side surface of the stave cooler in a manner to align their long sides in the direction of the height of the stave cooler to form a curved surface.
Figure 4B:
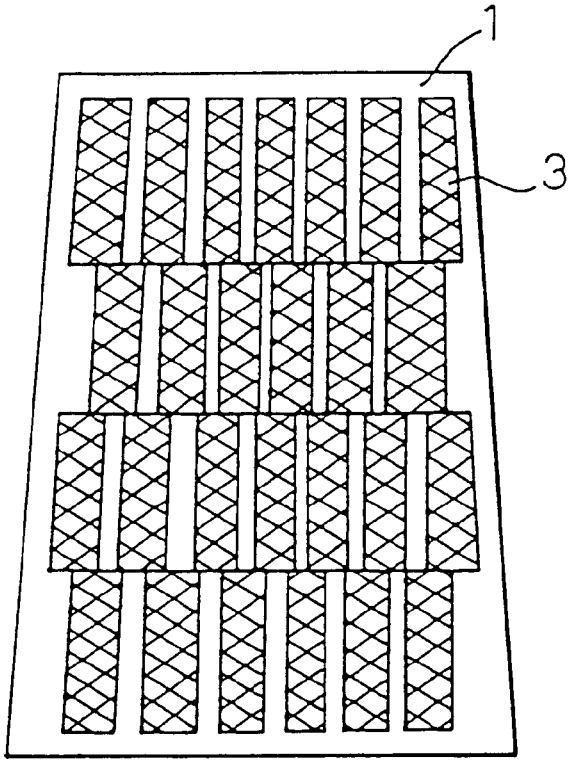

FIGS. 4(*a*) and (*b*) show a stave cooler in which latticed austenitic heat resistant steel plates 3 having openings are piled to form rectangular parallelepipeds and the rectangular parallelepipeds are arranged in the furnace interior side surface of a stave cooler proper 1 having a curved surface on the furnace interior side in a manner that the long sides of the rectangular parallelepipeds are aligned in the direction of the height of the stave cooler.

Because the surface on the furnace interior side of the stave cooler is curved to fit the curvature defined by the inner diameter of the blast furnace in this case, the short sides of a rectangular parallelepiped are made equal to the length of a chord corresponding, for example, to an angle of about 1° of the inner diameter of the blast furnace, and the rectangular parallelepipeds are arranged on the furnace interior side of the stave cooler in the furnace circumference direction.

In the curved surface on the furnace interior side, it is possible to arrange the rectangular parallelepipeds without any gap between them. However, since the inner surfaces of the shaft and bosh of a blast furnace are conical, in the stave coolers installed in these furnace portions, it is necessary to adjust the circumferential positions of the rectangular parallelepipeds by keeping gaps between them.

By this arrangement, joints of the base metal are formed in the direction of the height of the stave cooler on its curved furnace interior side surface. These joints increase flexural rigidity in the height direction of the stave cooler.

It should be noted that it is preferable to form the joints of the base metal discontinuously by arranging the rectangular parallelepipeds in a staggered pattern as shown in FIG. 4 in order to prevent continuous wear of the joints.

Figure 5:
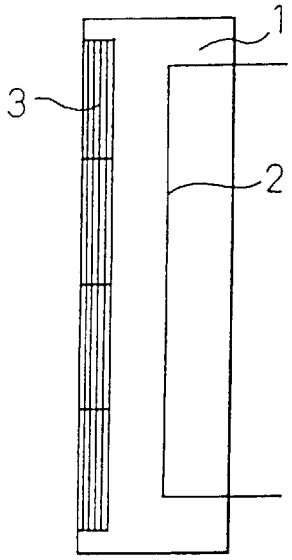
FIG. 5 is a sectional side elevation view of the stave cooler shown in FIG. 1.

FIG. 5 is a sectional side elevation view in the thickness direction of a stave cooler 1 where latticed heat resistant steel plates 3 having openings (5 plates in the figure)are piled into a lamination and embedded in the base metal on the furnace interior side of the stave cooler.

Since the heat resistant steel plates wear more slowly than embedded refractory bricks, due to their excellent resistance against wear and cracking, the thickness required to ensure a desired service life is less than in the case of conventional embedded refractory bricks. Compared with a conventional case where a refractory brick layer of 200 mm thickness is embedded, for example, when latticed heat resistant steel plates piled into a lamination are embedded, a thickness of 100 mm or so is sufficient to obtain the same service life.

Figure 6A:
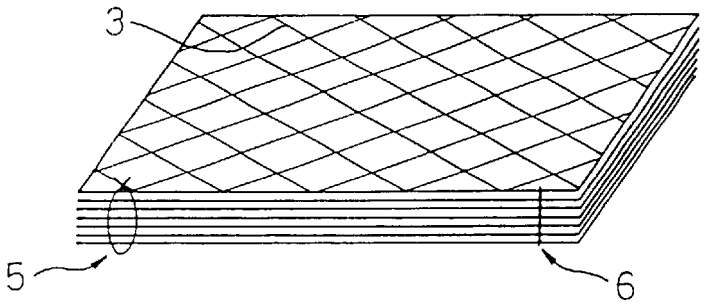
FIG. 6(*a*) is a perspective view showing a lamination in which latticed heat resistant steel plates having openings are piled.
Figure 6B:
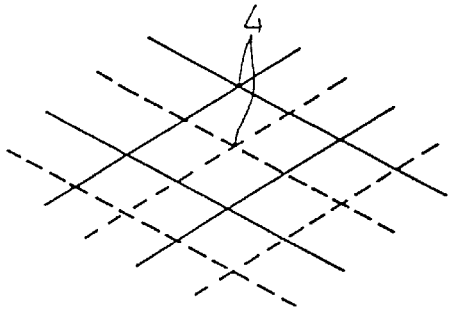
Figure 7:
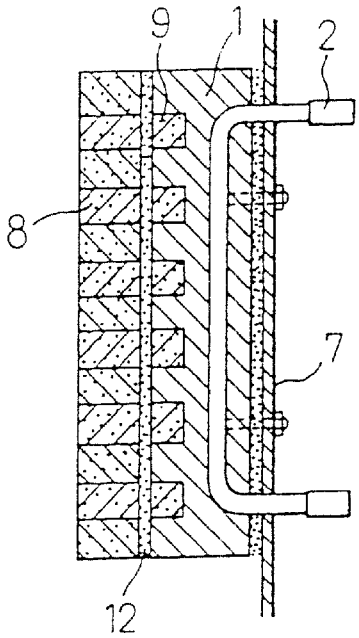
Fig.7 PRIOR ART
FIG. 7 is a sectional view of a conventional stave cooler.

FIG. 6(*a*) shows a construction of a lamination in which latticed heat resistant steel plates 3 having openings are piled.

Expanded metal sheets of austenitic stainless steel such as 18Cr-8Ni steel and the like available on the market can be used as the heat resistant steel plates 3.

Expanded metal sheets are available on the market in a variety of mesh sizes. A desirable mesh size is 30 mm or more in the shorter mesh diagonal, center to center, in consideration of the molten metal flow around crossings of mesh members in the lamination, and a desirable thickness of each sheet is 3 mm or more to ensure fusing damage resistance at casting.

When piling the heat resistant steel plates to a desired thickness, overlapping of lattice nodes 4 of adjacent plates must be avoided as shown in FIG. 6(*b*).

This arrangement ensures smooth flow of the molten base metal and, as a result, brings about an integrated composite of the base metal and the heat resistant steel plates.

The heat resistant steel plates 3 piled to a desired thickness must be bundled with wires 5 or fixed together by welding 6 or some other means (see FIG. 6(*a*)).

A lamination of the latticed heat resistant steel plates 3 having openings can be divided into sections of desired dimensions for ease of work, as shown in FIGS. 1 (*a*) and (*b*) and 4(*a*) and (*b*). It is desirable, in consideration of ease of work, that the dimensions of the sections be such that their unit weight is 20 kg or less when they are to be handled manually.

During mold preparation for casting the stave cooler according to the present invention, the lamination or the rectangular parallelepipeds formed by dividing the lamination may be fixed with chaplets or the like at the position(s) in the furnace interior side of the stave cooler.

Unlike refractory bricks, however, the heat resistant steel plates do not float during casting, and thus it is sufficient for a successful casting work to place them at prescribed positions.

The lamination and the rectangular parallelepipeds do not require any special pretreatment, such as shot blasting, wrapping with a cushioning material (ceramic felt, etc., indispensable in the conventional cases of embedded refractory bricks), prior to the stave cooler formation. It is desirable, however, to preheat and dry them sufficiently before casting so as to ensure good penetration of the molten metal and prevent occurrence of gas defects, etc. during casting.

The stave coolers according to the present invention and conventional stave coolers constructed with embedded refractory bricks were installed in an actually operating blast furnace and their performance was compared.

The heat insulation ability of conventionally structured stave coolers deteriorated prematurely (in about 6 months) as a result of cracking of the refractory bricks, whereas the stave coolers according to the present invention were in sound condition after use for 12 months, the temperature of the base metal being kept stable and low compared with the conventionally structured stave coolers.

The following excellent effects are obtained by embedding a latticed heat resistant steel plate having openings or latticed heat resistant steel plates having openings piled into a lamination in the furnace interior side surface of a stave cooler by casting, as stated above, instead of embedding refractory bricks:

(1) The rate of wear of a stave cooler on the furnace interior side surface is reduced, since the heat resistant steel has better resistance to abrasion and cracking than the refractory bricks or the base metal (nodular graphite cast iron).

(2) Falling out or local damage of the heat resistant steel plate(s) caused by thermal deformation of the stave cooler proper is prevented, since a homogeneous composite is obtained by piling the heat resistant steel plates in a manner that lattice nodes or slots of the heat resistant steel plates do not overlap.

(3) Stable operation of a blast furnace is ensured, since the furnace interior side surface of the stave cooler is kept smooth for a long period and smooth dropping of the material in the furnace is maintained as a result of the effect (2).

(4) Especially when rectangular parallelepipeds each of which is formed of a latticed heat resistant steel plate having openings or latticed heat resistant steel plates having openings piled into a lamination are arranged on the furnace interior side surface of a stave cooler in a manner that the long sides of the rectangular parallelepipeds are aligned in the direction of the height of the stave cooler, joints of the base metal are formed vertically and flexural rigidity of the stave cooler is increased, restraining its thermal deformation as a result. Damage to cooling pipes and leakage of hot furnace interior gas to furnace shells are thus prevented and the service life of a blast furnace is made longer.

(5) Work efficiency of stave cooler manufacturing is generally enhanced and the manufacturing costs are reduced, since, in casting the stave cooler according to the present invention, different from the conventional work to embed refractory bricks by casting, the work to fix components to be cast in to the mold and to wrap them with a cushioning material is not required.

(6) By making the dimension of the rectangular parallelepipeds in the stave cooler width direction short, different curvatures in the interior surface of a furnace can be versatilely coped with, and conventional design and manufacture of refractory bricks become unnecessary, and thus the costs and time of stave cooler manufacturing are reduced.

(7) Stave coolers are made thinner and consequently the manufacturing costs are decreased, due to the low wear rate of the stave cooler according to the present invention.

Industrial Applicability

It is important for maintaining stable operation of a metallurgical furnace such as a blast furnace that it be constructed using a structural design to keep its interior surface smooth during operation.

Whereas in a conventionally structured stave cooler having cast in refractory bricks, the refractory bricks wear out rapidly and ribs of a base metal are left protruding towards the furnace interior, making the furnace interior side surface of the stave cooler irregular as a result of different wear rates of the refractory bricks and the base metal (nodular graphite cast iron), no irregularity is created during furnace operation on the furnace interior side surface of a stave cooler composed homogeneously of a composite of latticed heat resistant steel plate(s) having openings and the base metal (nodular graphite cast iron), since the furnace interior side surface wears evenly.

The present invention makes it possible, in designing a metallurgical furnace, to design a furnace wall structure so that a homogeneous wear rate is obtained in the entire furnace interior surface during furnace operation. The present invention, therefore, contributes significantly to realizing continuous stable operation of a metallurgical furnace.

What is claimed is:

1. A stave cooler for location on an interior of a furnace wall to cool a furnace body, said stave cooler having a structure comprising a stave cooler metal base in which cooling pipes for cooling the stave cooler metal base are cast on a side of the stave cooler metal base opposite to a furnace interior side of the stave cooler metal base and heat resistant steel plates having openings are cast on the furnace interior side of the stave cooler metal base characterized in that the heat resistant steel plates are a lamination of heat resistant steel plates having openings and that the positions of the openings of a heat resistant steel plate are different from those of an adjacent heat resistant steel plate.

2. A stave cooler to cool a furnace body according to claim 1, characterized in that the heat resistant steel plates are latticed or slotted heat resistant steel plates.

3. A stave cooler for cooling a furnace body according to claim 1, wherein said stave cooler metal base has a thickness, characterized in that the lamination of the heat resistant steel plates has a minimum thickness of 3 mm and a maximum thickness of ⅔ the thickness of the stave cooler metal base.

4. A stave cooler to cool a furnace body according to claim 1, characterized in that the net volume of the lamination of the heat resistant steel plates is 20% to 60% of its gross volume, namely the sum of the net volume of the heat resistant steel plates and the volume of the space their openings form.

5. A stave cooler to cool a furnace body according to claim 1, characterized in that the minimum width of the openings of the heat resistant steel plates having openings is 30 mm or more and 70 mm or less.

6. A stave cooler to cool a furnace body according to claim 1, characterized in that the heat resistant steel plates having openings are austenitic or ferritic heat resistant steel plates.

7. A method for manufacturing a stave cooler for location on an interior of a furnace wall to cool a furnace body, comprising providing said stave cooler with a structure comprising a stave cooler metal base in which cooling pipes for cooling the stave cooler metal base are cast on a side of the stave cooler metal base opposite to a furnace interior side of the stave cooler metal base, said method characterized by:

forming a latticed or slotted heat resistant steel plate having openings or a lamination of latticed or slotted heat resistant steel plates having openings into a rectangular parallelepipeds casting a plurality of said rectangular parallelepipeds in the furnace interior side of the stave cooler metal base.

8. A method for manufacturing a stave cooler for cooling a furnace body according to claim 7, wherein said stave cooler metal base has a thickness, characterized in that said rectangular parallelepiped has a minimum thickness of 3 mm and a maximum thickness of ⅔ the thickness of the stave cooler metal base.

9. A method for manufacturing a stave cooler for cooling a furnace body according to claim 7, characterized in that the net volume of the rectangular parallelepiped is 20 to 60% of its gross volume, namely the sum of the net volume of the heat resistant steel plate and the volume of the space of the openings.

10. A method for manufacturing a stave cooler for cooling a furnace body according to claim 7, characterized in that in the rectangular parallelepiped the minimum width of the openings is 30 mm or more and 70 mm or less.

11. A method for manufacturing a stave cooler for cooling a furnace body according to claim 7, characterized in that the heat resistant steel plate is austenitic or ferritic heat resistant steel plate.

* * * * *